US011000171B2

(12) United States Patent
Nedelcoff

(10) Patent No.: US 11,000,171 B2
(45) Date of Patent: May 11, 2021

(54) DRY AND WET VACUUM CLEANER

(71) Applicant: Austin Nedelcoff, Iowa City, IA (US)

(72) Inventor: Austin Nedelcoff, Iowa City, IA (US)

( * ) Notice: Subject to any disclaimer, the term of this patent is extended or adjusted under 35 U.S.C. 154(b) by 454 days.

(21) Appl. No.: 16/185,268

(22) Filed: Nov. 9, 2018

(65) Prior Publication Data

US 2020/0146524 A1 May 14, 2020

(51) Int. Cl.
*A47L 11/30* (2006.01)
*A47L 7/00* (2006.01)

(52) U.S. Cl.
CPC ..... *A47L 11/302* (2013.01); *A47L 7/0014* (2013.01); *A47L 7/0023* (2013.01)

(58) Field of Classification Search
CPC .... A47L 11/302; A47L 7/0014; A47L 7/0023; A47L 7/0019
See application file for complete search history.

(56) References Cited

U.S. PATENT DOCUMENTS

2016/0037983 A1* 2/2016 Hillen ..... A47L 9/2847 134/6

* cited by examiner

*Primary Examiner* — Andrew A Horton
(74) *Attorney, Agent, or Firm* — The Iwashko Law Firm, PLLC; Lev Ivan Gabriel Iwashko

(57) ABSTRACT

A dry and wet vacuum cleaner, including a main body, including a main base disposed at a bottom portion of the main body, a dry debris collecting compartment disposed on the main base to store therein dry debris gathered from a surface, a liquid containing compartment disposed on the main base to store a liquid therein, and a water collecting compartment to store therein water collected from the surface, a dry vacuum connected to the dry debris collecting compartment to gather the dry debris from the surface, a wet vacuum connected to the water collecting compartment to gather the water from the surface, a plurality of nozzles connected to the main base to spray the liquid downward onto the surface, and a scrubbing cylinder disposed between the dry vacuum and the wet vacuum to scrub the surface.

3 Claims, 1 Drawing Sheet

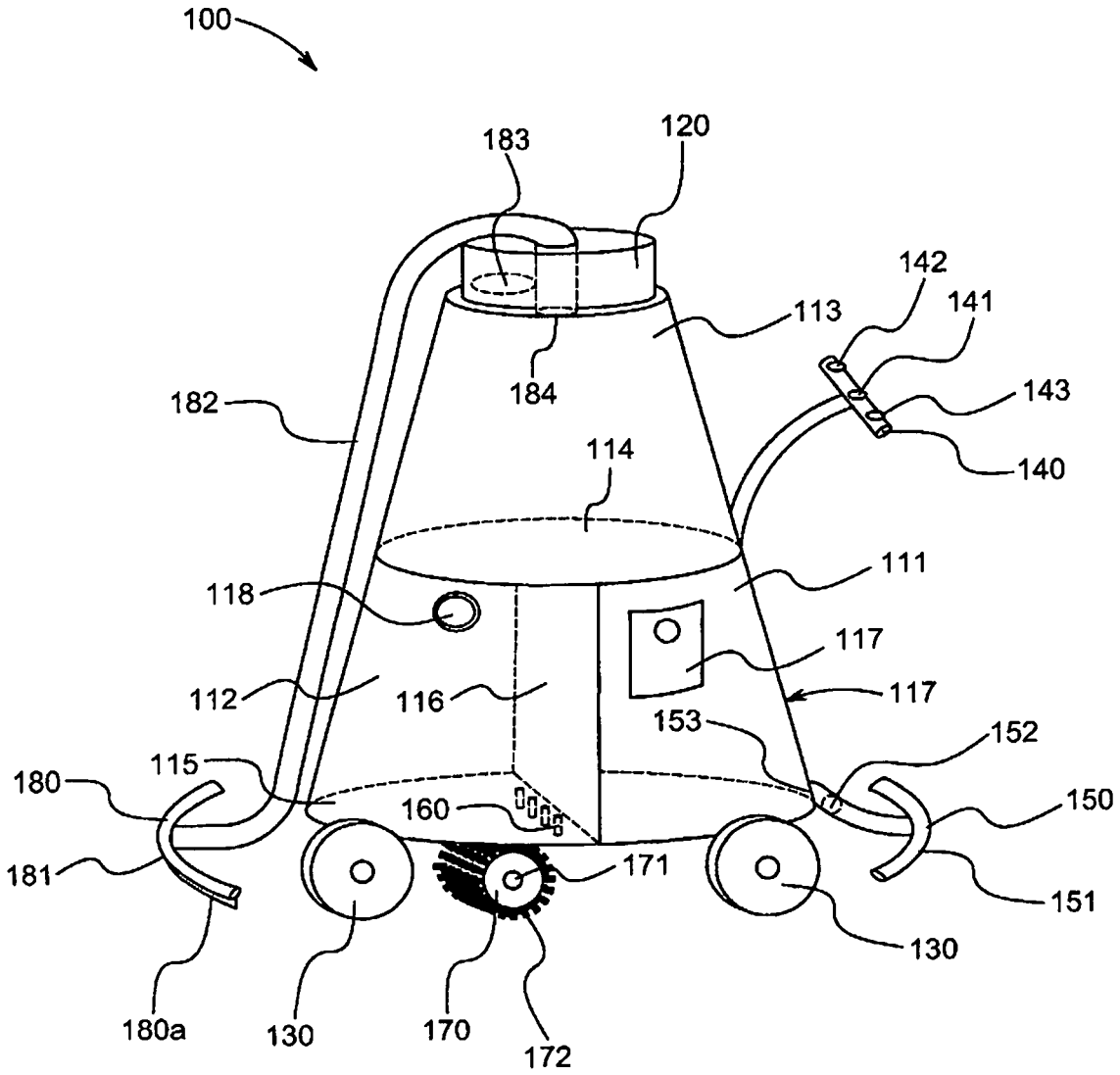
100
183
120
142
141
113
184
143
182
140
114
111
118
117
112
116
117
153
152
115
180
160
150
181
171
151
130
180a
130
170
172

DRY AND WET VACUUM CLEANER

BACKGROUND

1. Field

The present general inventive concept relates generally to a vacuum cleaner, and particularly, to a dry and wet vacuum cleaner.

2. Description of the Related Art

While cleaning tile floors is still a chore most could live without, the evolution of floor care tools has made it easier and more effective than ever. Finding the best vacuum for tile floors, or the best steam mop if that's priority is now the challenge, and deciphering between all the different products can be time-consuming.

Therefore, there is a need for a multi-purpose vacuum cleaner that sucks up dust, scrubs a floor with water, and then sucks up the remaining water.

SUMMARY

The present general inventive concept provides a dry and wet vacuum cleaner.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a dry and wet vacuum cleaner, including a main body, including a main base disposed at a bottom portion of the main body, a dry debris collecting compartment disposed on the main base to store therein dry debris gathered from a surface, a liquid containing compartment disposed on the main base to store a liquid therein, and a water collecting compartment to store therein water collected from the surface, a dry vacuum connected to the dry debris collecting compartment to gather the dry debris from the surface, a wet vacuum connected to the water collecting compartment to gather the water from the surface, a plurality of nozzles connected to the main base to spray the liquid downward onto the surface, and a scrubbing cylinder disposed between the dry vacuum and the wet vacuum to scrub the surface.

The dry and wet vacuum may further include a divider disposed between the dry debris collecting compartment and the liquid containing compartment to separate dry debris collecting compartment from the liquid containing compartment.

The dry and wet vacuum may further include a water collecting compartment base disposed at a bottom portion of the water collecting compartment, such that the water collecting compartment is disposed above the dry debris collecting compartment and the liquid containing compartment and separated from the dry debris collecting compartment and the liquid containing compartment by the water collecting compartment base.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates side perspective view of a dry and wet vacuum cleaner, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

FIG. 1 illustrates side perspective view of a dry and wet vacuum cleaner 100, according to an exemplary embodiment of the present general inventive concept.

The dry and wet vacuum cleaner 100 may include a main body 110, a lid 120, a plurality of wheels 130, a handle 140, a dry vacuum 150, at least one liquid spraying nozzle 160, a scrubbing cylinder 170, and a wet vacuum 180, but is limited thereto.

The main body 110 may include a dry debris collecting compartment 111, a liquid containing compartment 112, a water collecting compartment 113, a water collecting compartment base 114, a main base 115, a divider 116, a dust extracting door 117, and a water inserting aperture 118, but is not limited thereto.

The dry debris collecting compartment 111 may be designed to store vacuumed debris and dust thereinside.

The liquid containing compartment 112 may include a liquid 10, such clean water and/or cleaning solution disposed therein.

The water collecting compartment 113 may be designed to collect dirty water vacuumed by the wet vacuum 180.

The water collecting compartment base 114 may be a base portion and divider within a bottom portion of the water collecting compartment 113 to prevent the collected dirty water from entering the dry debris collecting compartment 111 and/or the liquid containing compartment 112.

The main base 115 may be a base for both the dry debris collecting compartment 111 and the liquid containing compartment 112, and the divider 116 may be a divider disposed between the dry debris collecting compartment 111 and the liquid containing compartment 112 to separate (i.e., divide) the dry debris collecting compartment 111 from the liquid containing compartment 112.

The dust extracting door 117 may be disposed on a surface of the main body 110 corresponding to the dry debris collecting compartment 111 to allow dry debris collected thereinside to be extracted therefrom.

The water inserting aperture 118 may be disposed on another surface of the main body 110 corresponding to the dry debris collecting compartment 111 to allow the liquid 11 to be inserted therein.

The lid 120 may be disposed at a top portion of the main body 110, and may be removable therefrom to allow any dirty water accumulated in the water collecting compartment 113 to be easily removed therefrom.

The plurality of wheels 130 may be disposed at a bottom portion of the main body 110, and may allow the dry and wet vacuum cleaner 100 to move in any direction desired by a user.

The handle 140 may be disposed at a side rear portion of the main body 110 to extend therefrom, and may include an on/off switch 141, a liquid spraying button 142, and a scrubbing cylinder activating button 143, but is not limited thereto. The handle 140 may be disposed on a same side as the dry vacuum 150, but is not limited thereto, and may be disposed on a side of the wet vacuum 180, or any other side of the dry and wet vacuum cleaner 100. As such, the dry and wet vacuum cleaner 100 may be push or pulled by a user, based on a user's preference.

The dry vacuum 150 may be disposed at a rear bottom portion of the main body 110, and may include a dry debris collecting aperture 151 at a bottom portion thereof, a dry vacuum motor 152, disposed therewithin and/or connected thereto, and a dry debris expelling aperture 153 at a connecting point between the dry vacuum 150 and the dry debris collecting compartment of the main body 111.

The at least one liquid spraying nozzle 160 may be disposed at a bottom portion of the main base 115 within a portion of the liquid containing compartment 112. A user may depress the liquid spraying button 142 to cause the at least one liquid spraying nozzle 160 to spray the liquid 10 stored within the liquid containing compartment 112 downward onto a floor and/or surface.

The scrubbing cylinder 170 may be disposed at a bottom portion of the main base 115 below the liquid containing compartment 112, and may include a motor 171 disposed therein, a plurality of bristles 172 disposed around a circumferential surface thereof. A user may depress the scrubbing cylinder activating button 143 to cause the scrubbing cylinder 170 to spin. When the scrubbing cylinder 170 spins, the floor and/or surface may be scrubbed by the bristles 172.

The wet vacuum 180 may include a rubber blade 180*a*, a water receiving aperture 181, a hose 182, a wet vacuum motor 183, and a water expelling aperture 184, but is not limited thereto. The on/off switch 141 may cause the wet vacuum motor 183 to turn on, thereby allowing dirty water disposed on the floor and/or surface, for example, to be sucked through the water receiving aperture 181 such that it is funneled through the hose 182, which is connected to a top portion of the lid 120, and expelled out from the water expelling aperture 184, which is disposed at a bottom portion of the lid 120, such that the dirty water enters the water collecting compartment 113. The rubber blade 180*a* acts as a final drying mechanism (i.e., like a squeegee for a car windshield) to wipe and/or dry the area vacuumed by the wet vacuum 180.

Therefore, when the dry and wet vacuum 100 is in full operation, the user may begin by pulling the handle 140 causing the dry and wet vacuum 100 to move backwards, that is, to cause the dry vacuum 150 to move in a direction that the user is moving. The user may then depress the on/off switch 141 to cause the dry vacuum motor 152 to be powered on, thereby sucking any dry debris off the ground, into the dry vacuum 150 through the dry debris collecting aperture 151, and into the dry debris collecting compartment of the main body 111 via the dry debris expelling aperture 153. In other words, the first items that the dry and wet vacuum 100 sucks up include any dry debris that is disposed on the ground and/or surface. The user may then depress the liquid spraying button 142 to cause the at least one liquid spraying nozzle 160 to spray the liquid 10 stored within the liquid containing compartment 112 downward onto a floor and/or surface. The user may also depress the scrubbing cylinder activating button 143 to cause the scrubbing cylinder 170 to spin. The initial depression of the on/off switch 141 may also cause the wet vacuum motor 183 to turn on, thereby causing any dirty water disposed on the ground and/or surface left over from the sprayed liquid 10 that was scrubbed by the scrubbing cylinder 170 to be sucked up.

Therefore, the dry and wet vacuum 100 first sucks up dry debris from a floor using the dry vacuum 150, then sprays a liquid on the floor using the at least one liquid spraying nozzle 160, then scrubs the floor using the bristles 172 of the scrubbing cylinder 170, then vacuums any dirty water remaining on the floor using the wet vacuum 180, and then wipes any remaining water using the rubber blade 180*a*.

Alternatively, instead of including separate buttons on the handle, the dry and wet vacuum 100 may include only the on/off switch 141 to cause the at least one liquid spraying nozzle 160 to spray a slow and constant stream of the liquid 10 out therefrom, and/or, may cause the scrubbing cylinder 170 to rotate.

Additionally, vacuum hoses and vacuum hose holders/hooks may be disposed on the dry and wet vacuum cleaner 100 to allow easy cleaning of dust/debris from hard-to-reach places.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A dry and wet vacuum cleaner, comprising:

a main body, comprising:

a main base disposed at a bottom portion of the main body, a dry debris collecting compartment disposed on the main base to store therein dry debris gathered from a surface, a liquid containing compartment disposed on the main base to store a liquid therein, and a water collecting compartment to store therein water collected from the surface, a dry vacuum connected to the dry debris collecting compartment to gather the dry debris from the surface;

a wet vacuum connected to the water collecting compartment to gather the water from the surface;

a plurality of nozzles connected to the main base to spray the liquid downward onto the surface; and a scrubbing cylinder disposed between the dry vacuum and the wet vacuum to scrub the surface.

2. The dry and wet vacuum of claim 1, further comprising:

a divider disposed between the dry debris collecting compartment and the liquid containing compartment to separate dry debris collecting compartment from the liquid containing compartment.

3. The dry and wet vacuum of claim 1, further comprising:

a water collecting compartment base disposed at a bottom portion of the water collecting compartment, such that the water collecting compartment is disposed above the dry debris collecting compartment and the liquid containing compartment and separated from the dry debris collecting compartment and the liquid containing compartment by the water collecting compartment base.

* * * * *